US008540055B2

(12) United States Patent
Ono et al.

(10) Patent No.: US 8,540,055 B2
(45) Date of Patent: Sep. 24, 2013

(54) OIL SUPPLYING APPARATUS FOR VEHICLE

(75) Inventors: Hisashi Ono, Okazaki (JP); Yuki Nishida, Kariya (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 1138 days.

(21) Appl. No.: 12/482,968

(22) Filed: Jun. 11, 2009

(65) Prior Publication Data

US 2009/0311115 A1 Dec. 17, 2009

(30) Foreign Application Priority Data

Jun. 12, 2008 (JP) ..... 2008-154564

(51) Int. Cl.
*F04B 49/00* (2006.01)
*F04B 35/00* (2006.01)
*F01M 1/02* (2006.01)

(52) U.S. Cl.
USPC ..... 184/6.28

(58) Field of Classification Search
USPC ..... 184/6.28, 7.4, 67; 123/196 R
See application file for complete search history.

(56) References Cited

U.S. PATENT DOCUMENTS 4,223,646 A 9/1980 Kinder
4,452,188 A * 6/1984 Kosuda et al. ..... 123/90.18
4,545,342 A 10/1985 Nakano et al.
4,800,850 A * 1/1989 Yoshida et al. ..... 123/90.16
5,220,891 A * 6/1993 Nakamura et al. ..... 123/90.16
5,666,915 A 9/1997 Kawashima et al.
5,904,226 A * 5/1999 Sakaguchi et al. ..... 184/67
7,025,032 B2 * 4/2006 Barber et al. ..... 123/196 R
2005/0061289 A1 3/2005 Plenzler et al.
2005/0061290 A1 * 3/2005 Plenzler et al. ..... 123/196 M (Continued)

FOREIGN PATENT DOCUMENTS

DE 196 25 296 A1 1/1997
DE 196 04 865 A1 8/1997

(Continued)

OTHER PUBLICATIONS

Office Action dated Apr. 24, 2012, issued by the Japanese Patent Office in corresponding Japanese Patent Application No. 2008-154564 and English Translation of Office Action. (7 pages).

(Continued)

*Primary Examiner* — William E Dondero
*Assistant Examiner* — Mark K Buse
(74) *Attorney, Agent, or Firm* — Buchanan Ingersoll & Rooney PC

(57) ABSTRACT

An oil supplying apparatus for a vehicle, includes an engine driven mechanical oil pump, a hydraulic actuator operated by pressure of oil supplied from the engine driven mechanical oil pump to the hydraulic actuator, an engine lubrication device lubricating each member of the engine with the oil supplied from the engine driven mechanical oil pump, and a priority flow valve selectively establishing priority flow and secondary flow conditions when a low oil pressure is working on the hydraulic actuator and when a high oil pressure is working on the hydraulic actuator, respectively, the priority flow condition allowing an oil supply from the engine driven mechanical oil pump to the hydraulic actuator with priority over an oil supply from the engine driven mechanical oil pump to the engine lubrication device, the secondary flow condition allowing the oil supply from the engine driven mechanical oil pump to the engine lubrication device.

16 Claims, 5 Drawing Sheets

(56) References Cited

U.S. PATENT DOCUMENTS

| | | | | |
|---|---|---|---|---|
| 2006/0260873 | A1* | 11/2006 | Suzuki et al. | 184/6.5 |
| 2011/0067667 | A1* | 3/2011 | Miyachi et al. | 123/196 R |
| 2011/0067668 | A1* | 3/2011 | Miyachi et al. | 123/196 R |

FOREIGN PATENT DOCUMENTS

| | | | |
|---|---|---|---|
| EP | 0 275 713 | A1 | 7/1988 |
| EP | 2 133 517 | A1 | 12/2009 |
| JP | 04-287815 | A | 10/1992 |
| JP | 6-212932 | A | 8/1994 |
| JP | 10-103034 | A | 4/1998 |
| JP | 10-141036 | A | 5/1998 |
| JP | 11-009910 | A | 1/1999 |
| JP | 2002-303111 | A | 10/2002 |
| JP | 2004- 16430 | A | 4/2004 |
| JP | 2004-143972 | A | 5/2004 |
| JP | 2008-19750 | A | 1/2008 |
| JP | 2008-291825 | A | 12/2008 |
| WO | WO 2010/013625 | A1 | 2/2010 |

OTHER PUBLICATIONS

Published Technical Information No. 2006-505946 with English Translation, published Nov. 9, 2006, 3 pages.

Search Report issued Oct. 28, 2009 in corresponding European Application No. 09 00 7753.8.

* cited by examiner

OIL SUPPLYING APPARATUS FOR VEHICLE

CROSS REFERENCE TO RELATED APPLICATIONS

This application is based on and claims priority under 35 U.S.C. §119 to Japanese Patent Application 2008-154564, filed on Jun. 12, 2008, the entire content of which is incorporated herein by reference.

FIELD OF THE INVENTION

The present invention relates to an oil supplying apparatus for a vehicle.

BACKGROUND

One of known oil supplying apparatuses for a vehicle is a lubrication oil supplying apparatus for an engine. The lubrication oil supplying apparatus includes a supply passage to a crank system for supplying lubrication oil discharged from an oil pump, which is a fixed displacement oil pump, driven by the engine to a main bearing of a crank shaft. The lubrication oil supplying apparatus for the engine also includes a supply passage to a valve train for supplying the lubrication oil discharged from the oil pump to lubricating portions of the valve train. In the lubrication oil supplying apparatus for the engine, an orifice for the crank system and an orifice for the valve train are provided on the supply passage to the crank system and the supply passage to the valve train respectively for varying resistance of oil flow in the passages. A control system controls the resistance of the orifice for the crank system to decrease and the resistance of the orifice for the valve train to increase as an engine speed increases (refer to paragraphs 0007 to 0013 and FIG. 1 of JP6-2112932A, herein after referred to as Reference 1). According to the lubrication oil supplying apparatus for the engine, the resistance of the orifice for the crank shaft is increased and the resistance of the orifice for the valve train is decreased at a low engine speed, thereby ensuring a sufficient amount of oil flow to the lubricating portions while reducing a discharge amount of the oil pump. At a high engine speed, the resistance of the orifice for the crank shaft is decreased and the resistance of the orifice for the valve train is increased, thereby ensuring a sufficient amount of oil flow to the main bearing of the crank shaft while reducing the discharge amount of the oil pump. At the same time, an amount of oil supplied to the lubricating portions of the valve train via the supply passage to the valve train is prevented from being excessive, and thus an amount of oil returning from the lubricating portions of the valve train to an oil pan is controlled not to exceed a collecting capacity of a passage that returns the oil to the oil pan.

In a similar oil supplying apparatus for a vehicle, oil is discharged from an oil pump driven by an engine to a main passage, and then supplied to lubricating portions of a crank system via a branch passage to the crank system and to lubricating portions of a valve train via a branch passage to the valve train. According to the oil supplying apparatus for the vehicle, a variable displacement oil pump is used. The variable displacement oil pump reduces a discharge amount thereof at or above a predetermined discharge pressure. The oil supplying apparatus for the vehicle also includes a fluid pressure sensing variable throttle provided on the branch passage to the valve train for increasing resistance of oil flow by throttling the oil flow as fluid pressure increases, or an oil temperature sensing variable throttle provided on the main passage for decreasing the resistance of oil flow by widening the oil flow as an oil temperature increases (refer to paragraphs 0006 to 0014 and FIG. 1 of JP2002-303111A, hereinafter referred to as Reference 2). A case where the fluid pressure sensing variable throttle is provided on the branch passage to the valve train is described below. When the discharge pressure rises as a discharge amount of the oil pump is increased by an increased engine speed, the resistance of the oil flow in the branch passage to the valve train is increased to prevent more lubrication oil from being supplied to the branch passage to the valve train than is needed. Consequently, a greater amount of lubrication oil is supplied to the branch passage to the crank system. As a result, the variable displacement oil pump is applied to supply an appropriate supply amount of the lubrication oil to the branch passage to the crank system. A case where the oil temperature sensing variable throttle is provided on the main passage will be describe below. At a low oil temperature, when the discharge amount of the oil pump is increased by the increased engine speed, the discharge pressure of the oil pump increases more rapidly compared to at a higher oil temperature. Consequently, at the low oil temperature, the discharge pressure of the oil pump reaches a predetermined discharge pressure (a pressure at which the oil temperature sensing variable throttle starts functioning) when the engine speed is lower, compared to at the high oil temperature. After the predetermined discharge pressure is reached, the supply of the lubrication oil to the main passage is reduced.

One of known engine oil supplying apparatuses is provided not only with a mechanical oil pump but also with an electric oil pump assisting the mechanical oil pump. In the engine oil supplying apparatus, a discharge port of the mechanical oil pump and an intake port of the electric oil pump are coupled to each other to parallelly connect the mechanical oil pump and the electrical oil pump. The engine oil supplying apparatus includes a first relief valve that opens when a fluid pressure of the discharge port of the mechanical oil pump is equal to or greater than a first predetermined fluid pressure so as to control the fluid pressure of the discharge port of the mechanical oil pump at or under the first predetermined fluid pressure, and a check valve connected to both ends of the electric oil pump for allowing oil to flow from the intake port to a discharge port of the electric oil pump. The engine oil supplying apparatus also includes a second relief valve provided between the discharge port of the electric oil pump and an oil jet for opening when a fluid pressure of the discharge port of the electric oil pump is equal to or greater than a second predetermined fluid pressure so as to allow the oil to flow from the discharge port of the electric oil pump to the oil jet (refer to paragraphs 0011 to 0013 and FIG. 1 of JP2004-116430A, hereinafter referred to as Reference 3). According to the engine oil supplying apparatus, the discharge port of the mechanical oil pump is connected to a lubrication passage for supplying lubrication oil to each part of the engine, the discharge port of the electric oil pump is connected to a variable valve timing system (valve timing control device), and the second predetermined fluid pressure is set to be higher than the first predetermined fluid pressure. Consequently, the variable valve timing system of the engine oil supplying apparatus is operated by operating the electric oil pump when an engine speed is low, and the electric oil pump is stopped when the engine speed is high. In addition, when the engine speed is high, the electric oil pump is actuated to operate the oil jet.

According to the oil supplying apparatuses disclosed in References 1 and 2, an amount of supplied oil by the oil pump is considered in controlling the fluid pressure but pressure of the supplied oil is not considered because the oil is supplied from the oil pump for lubrication purpose. Consequently, when a hydraulic actuator or similar system is provided on a hydraulic circuit of the aforementioned oil supplying apparatus, problems including delay in operation of the hydraulic actuator may occur. In particular, it is unavoidable that the operation of the hydraulic actuator is unstable due to insufficient fluid pressure when the engine speed is not high enough, for example, at engine start, because the mechanical oil pump is driven by the engine. According to the engine oil supplying apparatus disclosed in Reference 3, the mechanical oil pump and the electric oil pump assisting the mechanical oil pump are serially arranged, so that the electric oil pump compensates the insufficient fluid pressure of the mechanical oil pump. However, application of the electric oil pump for assisting the mechanical oil pump causes increased cost and weight, and a tight installation space.

A need thus exists for an oil supplying apparatus for a vehicle, which is not susceptible to the drawback mentioned above.

SUMMARY OF THE INVENTION

According to an aspect of the present invention, an oil supplying apparatus for a vehicle includes an engine driven mechanical oil pump, a hydraulic actuator operated by pressure of oil supplied from the engine driven mechanical oil pump to the hydraulic actuator, an engine lubrication device lubricating each member of the engine with the oil supplied from the engine driven mechanical oil pump, and a priority flow valve selectively establishing priority flow and secondary flow conditions when a low oil pressure is working on the hydraulic actuator and when a high oil pressure is working on the hydraulic actuator, respectively, the priority flow condition allowing an oil supply from the engine driven mechanical oil pump to the hydraulic actuator with priority over an oil supply from the engine driven mechanical oil pump to the engine lubrication device, the secondary flow condition allowing the oil supply from the engine driven mechanical oil pump to the engine lubrication device.

BRIEF DESCRIPTION OF THE DRAWINGS

The foregoing and additional features and characteristics of the present invention will become more apparent from the following detailed description considered with the reference to the accompanying drawings, wherein.

DETAILED DESCRIPTION

Figure 1:
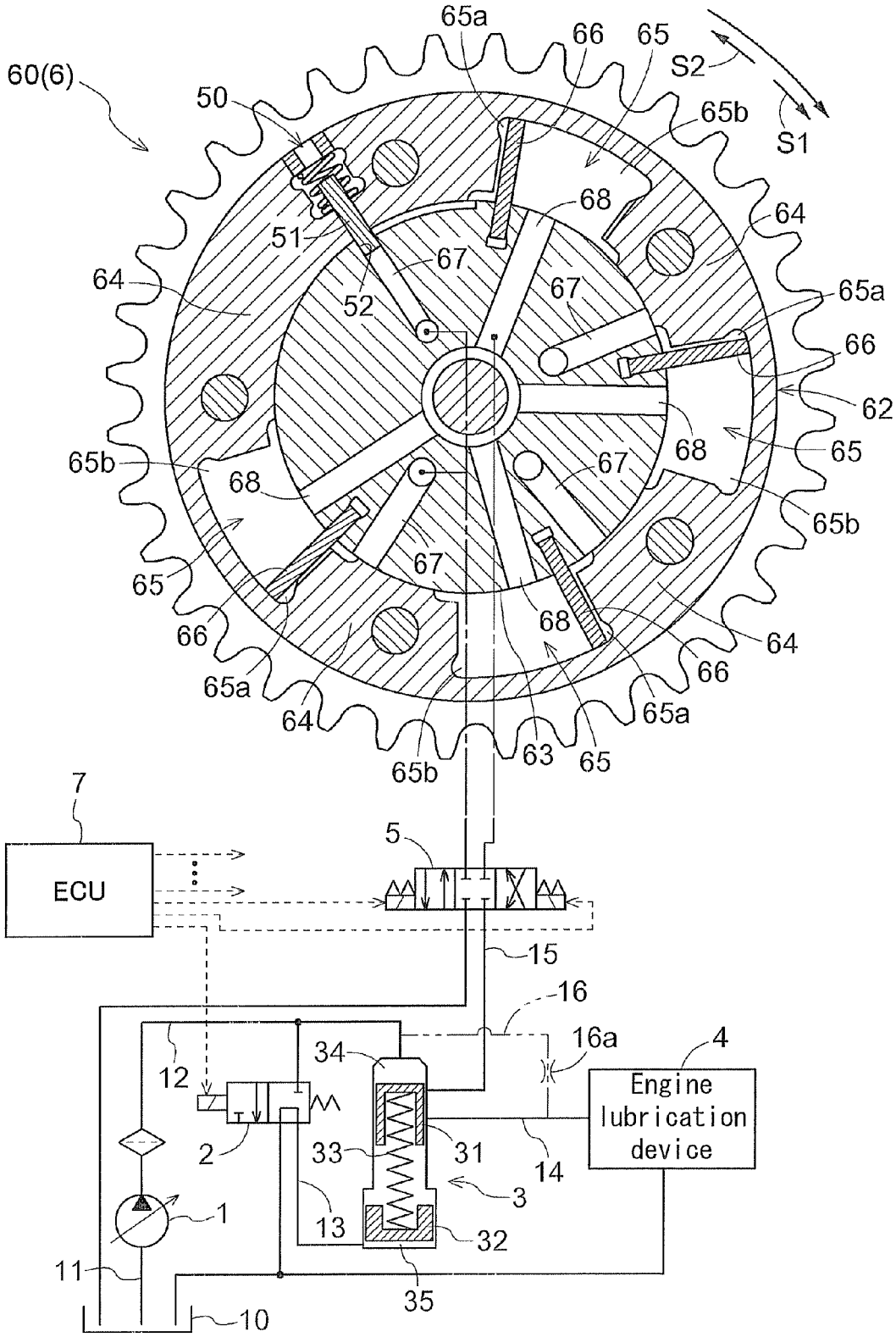
FIG. 1 is a configuration diagram showing an example of an oil supplying apparatus for a vehicle according to a first embodiment of the present invention.

A first embodiment of the present invention will be explained with reference to the illustrations as follows. Terms used in the embodiments for indicating the directions, such as upper, lower, should be understood to be as viewed in the illustrations. As shown in FIG. 1, in an oil supplying apparatus for a vehicle of this embodiment, oil is supplied from an engine driven mechanical oil pump 1 (hereinafter referred to as an oil pump 1) coupled to an output shaft of an engine to an engine lubrication device 4 that lubricates each member of the engine and to a valve timing control system 6 serving as a hydraulic actuator. The oil supplying apparatus of this embodiment further includes a priority flow valve 3 for supplying priority flow from the oil pump 1 to the valve timing control system 6 by regulating secondary flow from the oil pump 1 to the engine lubrication device 4 when a low fluid pressure is working on the valve timing control system 6, and for supplying the secondary flow when a high fluid pressure is working on the valve timing control system 6.

The priority flow valve 3 is structured to serve as a regulation valve, such as a pressure control valve or a throttle valve each having variability, for regulating an amount of oil flow to the engine lubrication device 4. In this embodiment, the priority flow valve 3 is structured specifically as the variable pressure control valve.

The oil pump 1 sucks the oil from an oil pan 10 via an oil intake passage 11 and discharges the oil to an oil discharging passage 12 provided with an oil filter. Connected to an end portion of the oil discharging passage 12 is an inlet port of the variable pressure control valve 3. The variable pressure control valve 3 includes two outlet ports. An oil supply passage 14 for supplying the oil to the engine lubrication device 4 is connected to one of the two outlet ports, and an oil supply passage 15 for supplying the oil to the valve timing control system 6 is connected to the other one of the two outlet ports. Three states are generated depending on a position of a valve body 31 of the variable pressure control valve 3 that is schematically illustrated in FIG. 1. The priority flow is supplied in a priority state, the priority flow and the secondary flow are supplied in a normal state, and neither the priority flow nor the secondary flow is supplied in a closed state. The above-described states are generated by movement of the valve body 31, and the regulation valve 3 is structured so that the movement of the valve body 31 is defined by the fluid pressure of the oil supply passage 15, that is, the fluid pressure working on the valve timing control system 6. To structure the regulation valve 3 as above, a spring 33 is provided in a manner that one end portion thereof contacts an upper surface of a retainer 32 and the other end portion contacts a lower surface of the valve body 31. The retainer 32 is made to have a pressure working area greater than that of the valve body 31. A first pressure working chamber 34 is provided above the upper surface of the valve body 31, and the oil discharging passage 12 is connected to the first pressure working chamber 34. A second pressure working chamber 35 is provided under the lower surface of the retainer 32, and a branch passage 13 is connected to the second pressure working chamber 35. The branch passage 13 branches from the oil discharging passage 12 and includes thereon an on-off valve 2, which is a solenoid-operated valve. A fluid pressure inside the second pressure working chamber 35 is regulated by controlling the on-off valve 2. As a result, a biasing force of the spring 33 against the valve body 31 is adjusted.

With the above-described structure of the variable pressure control valve 3, when the fluid pressure of the oil supply passage 15 is equal to or less than a predetermined fluid pressure, a force to bring the valve body 31 down against the biasing force of the spring 33 is small. Consequently, only the outlet port connected to the oil supply passage 15 supplying the oil to the valve timing control system 6 is opened and the outlet port connected to the oil supply passage 14 supplying the oil to the engine lubrication device 4 is closed. The force to bring the valve body 31 down increases when the fluid pressure of the oil supply passage 15 exceeds the predetermined fluid pressure, and thus the outlet port connected to the oil supply passage 14 supplying the oil to the engine lubrication device 4 is opened. In the meantime, when the fluid pressure in the second pressure working chamber 35 increases, a set length of the spring 33 shortens and the biasing force increases. As a result, the oil supply passage 15 to the valve timing control system 6 and the oil supply passage 14 to the engine lubrication device 4 are closed. The fluid pressure of the oil supply passage 15 is regulated by regulating a fluid pressure in the first pressure working chamber 34. That is, the fluid pressure of the oil supply passage 15 serves as a threshold at which the state where the oil is supplied only to the oil supply passage 15 leading to the valve timing control system 6 (the priority state) is changed to the state where the oil is supplied to the oil supply passage 15 leading to the valve timing control system 6 and to the oil supply passage 14 leading to the engine lubrication device 4 (the normal state).

As widely known, the engine lubrication device 4 supplies the oil to all the portions where lubrication oil is needed in and around the engine, including bearings, piston jets, chain jets, lash adjustors. The oil returned from these portions is collected and retained in the oil pan 10.

The structure of the valve timing control system 6 where the oil is supplied via the oil supply passage 15 will be described as follows. The valve timing control system 6 includes a phase control unit 60 and a control valve 5. The valve timing control system 6 controls a rotation phase of an intake camshaft 61 to be advanced or retarded relative to a rotation phase of a crankshaft, and to be maintained at an arbitrary phase. The phase control unit 60 includes an outer rotor 62 rotating synchronously with the crankshaft, and an inner rotor 63 located coaxially with the outer rotor 62 and rotating synchronously with the intake camshaft 61. The control valve 5 controls supply and discharge of the oil, thereby controlling a relative rotation phase of the outer rotor 62 and the inner rotor 63.

The outer rotor 62 is provided with plural protrusions 64 circumferentially spaced from each other and each functioning as a shoe that protrudes inwardly in a radial direction of the outer rotor 62. Provided between the adjacent protrusions 64 is a pressure chamber 65 defined by the outer rotor 62 and the inner rotor 63. A vane 66 is provided on an outer peripheral surface of the inner rotor 63 at a position facing the corresponding pressure chamber 65 so as to radially outwardly project. An end portion of the vane 66 in the radial direction of the outer rotor 62 slides along an inner surface of the pressure chamber 65 as the inner rotor 63 and the outer rotor 62 rotate relative to each other. The vane 66 separates the pressure chamber 65 into an advancing chamber 65*a* and a retarding chamber 65*b*. The advancing chamber 65*a* of the pressure chamber 65 that is in communication with an advancing passage 67 provided on the inner rotor 63, and the retarding chamber 65*b* of the pressure chamber 65 is communicated with a retarding passage 68 provided on the inner rotor 63. The advancing passage 67 and the retarding passage 68 respectively have hydraulic communication with the control valve 5.

A lock mechanism 50 is provided between the inner rotor 63 and the outer rotor 62 for locking the relative rotation phase of the inner rotor 63 and the outer rotor 62. The lock mechanism includes a lock pin 51 provided on the outer rotor 62 and an engaging concave portion 52 provided on the inner rotor 63 for receiving the lock pin 51. The advancing passage 67 that is in communication with the advancing chamber 65*a* which, among the four advancing chambers 65*a*, is adjacent to the lock mechanism 50, serves as a flow path communicating with the advancing chamber 65*a* via the engaging concave portion 52 of the lock mechanism 50. That is, the advancing passage 67 provides hydraulic communication between the control valve 5 and the engaging concave portion 52, and then between the engaging concave portion 52 and the advancing chamber 65*a* via a flow passage formed along a sliding surface of the inner rotor 63 relative to the outer rotor 62. The control valve 5 controls the supply of the oil to one or both of the advancing chamber 65*a* and the retarding chamber 65*b*, and controls the discharge of the oil from any one or both of the advancing chamber 65*a* and the retarding chamber 65*b*. Thus, the relative rotation phase of the inner rotor 63 and the outer rotor 62 changes in an advancing direction S1 or to a retarding direction S2.

Figure 2:
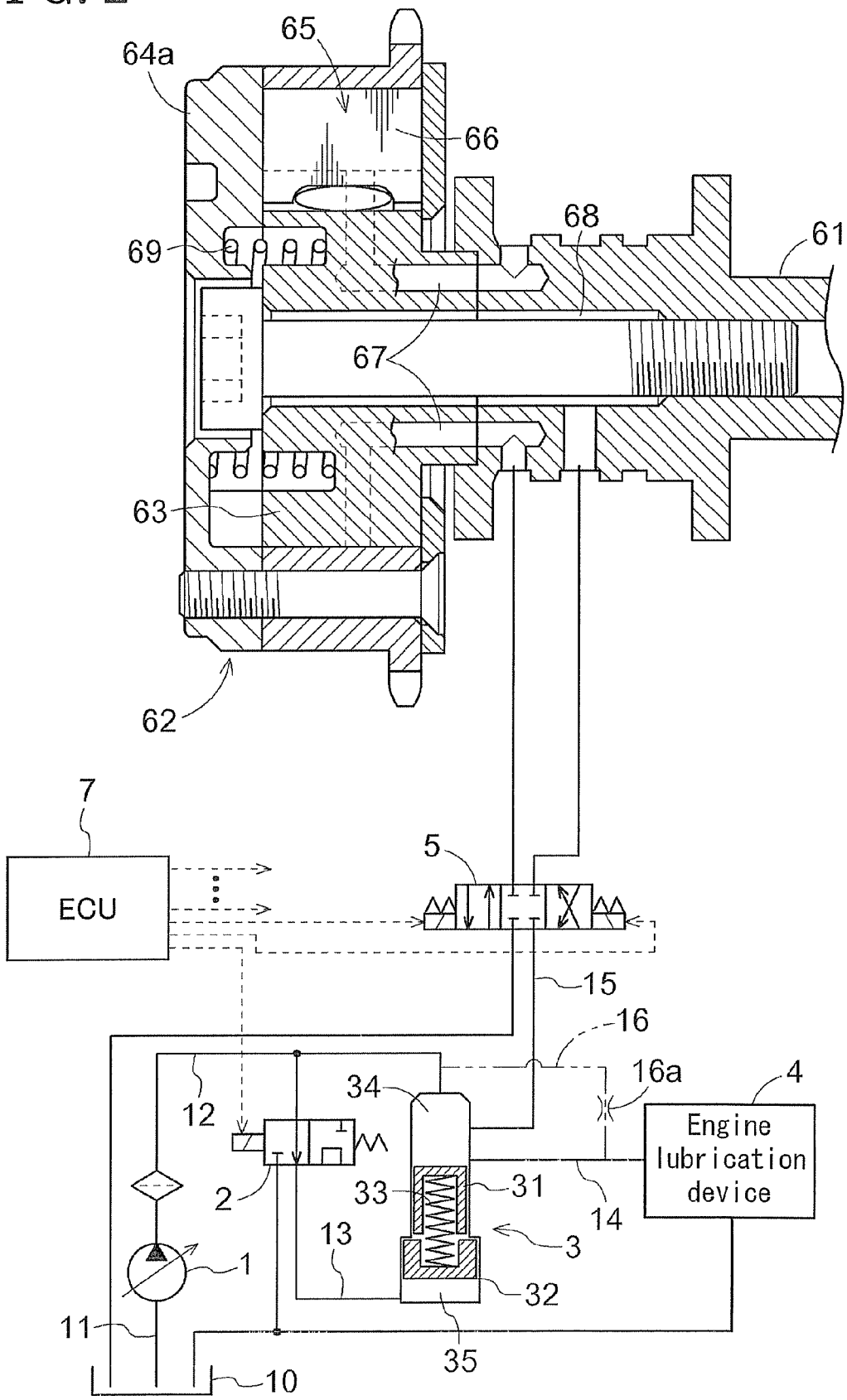
FIG. 2 is a cross sectional view of a valve timing control system shown in FIG. 1.

As shown in FIG. 2, a torsion spring 69 is provided between the inner rotor 63 and a front plate 64*a* fixedly attached to the outer rotor 62. One end of the torsion spring 69 is retained by a retainer provided on the inner rotor 63 and the other end is retained by a retainer provided on the front plate 64*a*. The torsion spring 69 provides a torque so as to always bias the inner rotor 63 and the outer rotor 62 in the advancing direction S1, that is, in a direction that the relative rotation phase of the inner rotor 63 and the outer rotor 62 advances.

When no fluid pressure is applied, the relative rotation phase of the outer rotor 62 and the inner rotor 63 is restricted to be in a lock phase by the lock mechanism 50 as shown in FIG. 1. For example, when the engine is stopped, the intake camshaft 61 is restricted to be in the lock phase (most retarded angle phase). When the control valve 5 is switched so as to generate the fluid pressure and the oil is supplied to the advancing passage 67, the lock pin 51 is disengaged from the engaging concave portion 52, thereby releasing the restriction caused by the lock mechanism 50. At this time, the oil is also supplied to the advancing chamber 65*a*, and thus the relative rotation phase changes in the advancing direction S1 after the lock mechanism 50 is released. After that, the relative rotation phase changes to be in an arbitrary phase between the most advanced angle phase and the most retarded angle phase.

In the oil supply apparatus for the vehicle having the aforementioned structure, an example of operations of the on-off valve 2 and the variable pressure control valve 3 will be described as follows. The on-off valve 2 and the control valve 5 are connected to an ECU (electronic control unit) 7, and the operations of the on-off valve 2 and the control valve 5 are controlled through control signals that are generated according to a drive condition of the vehicle and that are sent from the ECU. When the engine is stopped and the oil pump 1 stops running, no fluid pressure is applied to the oil discharging passage 12. This decreases the fluid pressure in the first pressure working chamber 34 of the variable pressure control valve 3, and thus the valve body 31 is pushed upward by the biasing force of the spring 33, thereby blocking the oil supply to the engine lubrication device 4 and to the valve timing control system 6. At this time, the oil supply passage 15 is also closed, and thus the oil is prevented from escaping from the valve timing control system 6 unless the control valve 5 is switched to an open state. Consequently, the fluid pressure of the valve timing control system 6 increases quickly, thereby improving operation responsiveness of the valve timing control system 6.

A state of the variable pressure control valve 3, that is a position of the valve body 31, is determined by a balance among the fluid pressure of the second pressure working chamber 35 determined by the operation of the on-off valve 2, the spring 33 and the fluid pressure in the first pressure working chamber 34. Here, by controlling the on-off valve 2, either one of two fluid pressure values is selectively set as the predetermined fluid pressure for determining the state of the valve 3. The two fluid pressures are a first predetermined fluid pressure (approximately 100 kPa) and a second predetermined fluid pressure (approximately 400 kPa) that is higher than the first predetermined fluid pressure. As the engine starts and the oil pump 1 starts running, the valve body 31 moves so as to open only the outlet port to the oil supply passage 15 when the fluid pressure in the first pressure working chamber 34 is lower than the first predetermined fluid pressure, and thus the priority flow is supplied. As a result, the fluid pressure of the valve timing control system 6 increases quickly because the oil delivered by the oil pump 1 is supplied only to the valve timing control system 6. When a higher fluid pressure than a fluid pressure required for operating the valve timing control system 6 is given as the first predetermined fluid pressure, the on-off valve 2 does not supply the secondary flow until the valve timing control system 6 is ready to operate, and thus the operation of the valve timing control system 6 is prioritized. When it is required that the oil should be supplied to the engine lubrication device 4 at the time of engine start-up even in a small quantity, a bypass oil passage 16 may be provided between the oil discharging passage 12 and the oil passage 14 to the engine lubrication device 4 of the engine, and a throttle 16*a* may be provided on the bypass oil passage 16.

When the second predetermined fluid pressure is applied instead of the first predetermined fluid pressure, even higher fluid pressure is achieved in the valve timing control system 6, and thus the valve timing control system 6 is able to respond to a rapid acceleration of the engine. Even when an engine speed is low and a discharge amount of the oil pump 1 is not sufficient, the fluid pressure of the valve timing control system 6 is increased by supplying the priority flow. That is, by selecting the second predetermined fluid pressure when an improved responsiveness of the valve timing control system 6 is required and by selecting the first predetermined fluid pressure when a lower responsiveness is acceptable, the valve timing control system 6 appropriately operates as the hydraulic actuator with use only of the oil pump 1, which is the engine driven mechanical oil pump.

When the engine speed is high, the discharge amount of the oil pump 1 is also high, and thus the higher fluid pressure works on the valve timing control system 6, thereby there is no need to set the second predetermined fluid pressure. Also, when an oil temperature is too high or too low, it is preferable to select the first predetermined fluid pressure instead of the second predetermined fluid pressure in order to have the valve timing control system 6 operate appropriately.

Figure 3:
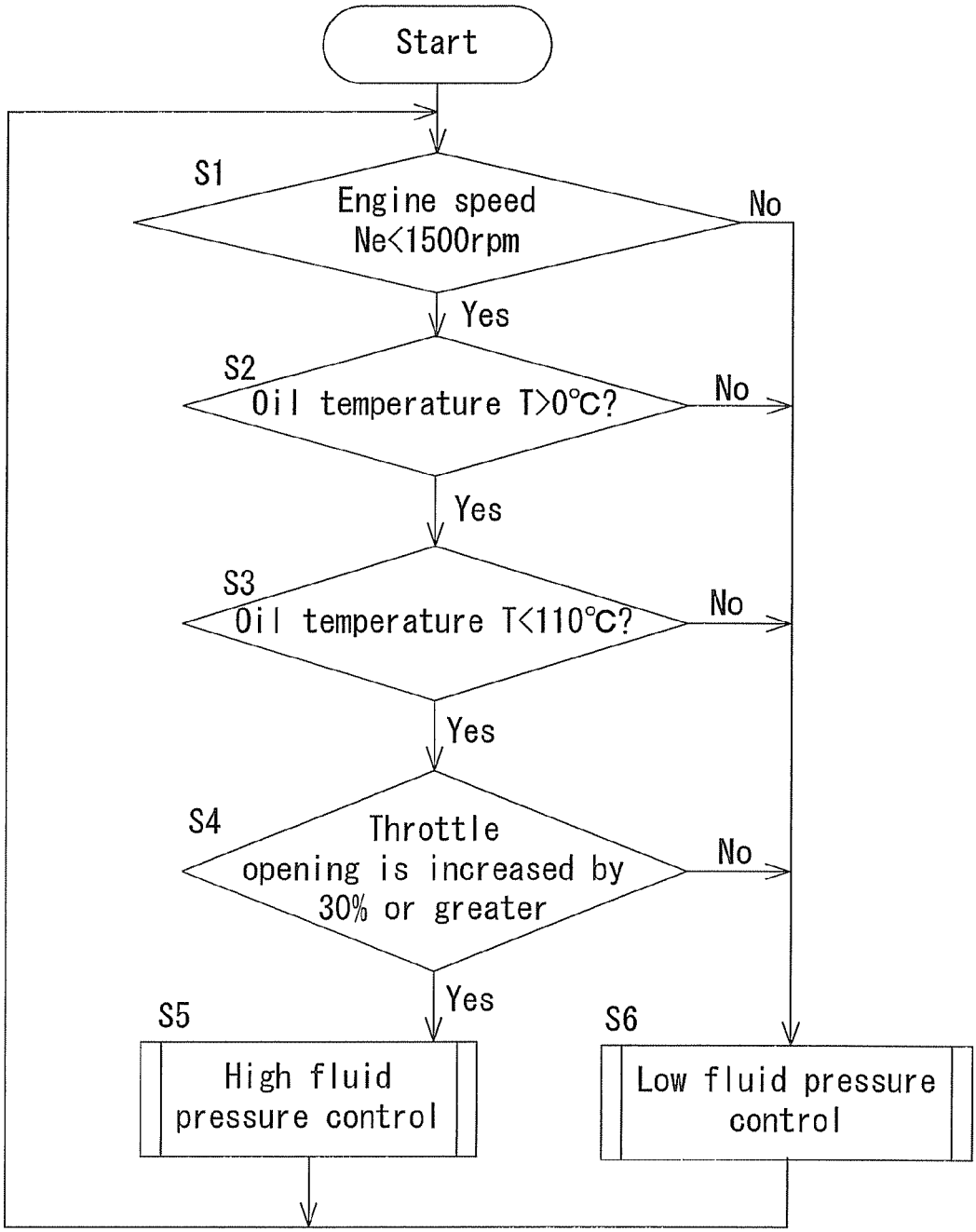
FIG. 3 is a flowchart of a control routine of a control valve.

FIG. 3 shows an example of a control routine applied to the on-off valve 2 considering the forgoing descriptions. In the control routine, it is determined which of the predetermined fluid pressure is set, the first predetermined fluid pressure or the second predetermined fluid pressure. Conditions to select the second predetermined fluid pressure are judged in the control routine, and the second predetermined fluid pressure is selected when all the conditions are met and the first predetermined fluid pressure is selected otherwise. The control routine is executed in a control valve control section provided in the ECU 7. First, it is determined on the basis of a signal from an engine speed detection sensor whether or not an engine speed Ne is equal to or less than 1500 rpm (S1). When the engine speed Ne is less than 1500 rpm (Yes in S1), it is determined on the basis of a signal from an oil temperature sensor whether or not an oil temperature T exceeds 0 degrees Celsius (S2). When the oil temperature exceeds 0 degrees Celsius (Yes in S2), it is further determined whether or not the oil temperature T is less than 110 degrees Celsius (S3). When the oil temperature T is less than 110 degrees Celsius (Yes in S3), it is determined on the basis of a signal from an acceleration operation detection sensor whether or not a throttle opening is increased by 30% or greater (S4). When the throttle opening is increased by 30% or greater (Yes in S4), a high fluid pressure control is performed on the on-off valve 2 (S5). Under the high fluid pressure control, a valve opening pressure to open the outlet port connected to the oil supply passage 15 to the valve timing control system 6 is set at the second predetermined fluid pressure by making an open time of the on-off valve 2 longer, thereby increasing the fluid pressure of the second pressure working chamber 35 of the variable pressure control valve 3. Accordingly, the fluid pressure of the valve timing control system 6 increases (approximately 400 kPa).

When the engine speed Ne is judged to exceed 1500 rpm in Step S1 (No in S1), a low fluid pressure control is performed on the on-off valve 2 (S6). Under the low fluid pressure control, the valve pressure to open the outlet port connected to the oil supply passage 15 to the valve timing control system 6 is set at the first predetermined fluid pressure by reducing the oil supply from the on-off valve 2 to the second pressure working chamber 35 of the valve 3, thereby reducing the fluid pressure of the second pressure working chamber 35. Accordingly, the fluid pressure of the valve timing control system 6 decreases (approximately 100 kPa). This is because when the engine speed Ne exceeds 1500 rpm, the discharge amount of the oil pump 1 is large, and thus the fluid pressure of the valve timing control system 6 is high. Consequently, there is no need to perform the high fluid pressure control on the on-off valve 2.

In a similar way, when the oil temperature T is judged to be 0 degrees Celsius or less (No in S2), the low fluid pressure control is performed on the on-off valve 2 (Step S6). This is because when the oil temperature is as low as 0 degrees Celsius or less, viscosity of the oil increases, and thus the pressure of the oil tends to increase, which eliminates the necessity of performing the high fluid pressure control on the on-off valve 2. When the oil temperature T is judged to be 110 degrees Celsius or greater in Step S3 (No in S3), the low oil temperature control is performed on the on-off valve 2 (Step S6). This is because a fluid pressure in the engine lubrication device 4 may be too low when the temperature of the oil rises to 110 degrees Celsius or higher. To prevent the fluid pressure in the engine lubrication device 4 from further decreasing, the low fluid pressure control is performed on the on-off valve 2. When the throttle opening is judged to be increased by less than 30% in Step S4 (No in Step S4), the low oil temperature control is performed on the on-off valve 2 (Step S6) because it is considered that the vehicle is not in a sudden acceleration state and thus the valve timing control system 6 operates sufficiently under the low fluid pressure control. As described above, only when all the conditions from Step S1 to Step S4 are met, the high fluid pressure control is performed on the on-off valve 2 and the fluid pressure of the valve timing control system 6 increases.

In the above-described oil supplying apparatus for the vehicle, the priority flow is supplied when the fluid pressure working on the valve timing control system 6 is low. In addition, the fluid pressure working on the valve timing control system 6 is appropriately selected from between a high pressure and a low pressure depending on a state of the vehicle.

Another embodiment of the present invention will be described as follows.

(1) In the first embodiment, the priority state where the priority flow is supplied to the valve timing control system 6 serving as the hydraulic actuator when a pressure (fluid pressure) working on the first pressure working chamber 34 is lower than the predetermined fluid pressure, the normal state where the primary flow and the secondary flow are supplied to the valve timing control system 6 and to the engine lubrication device 4 respectively when the pressure working on the first pressure working chamber 34 is higher than the predetermined fluid pressure, and the closed state where neither the priority flow nor the secondary flow is supplied are generated. The predetermined fluid pressure serving as a criterion for selecting the state is variable and provided by the on-off valve 2 and the second pressure working chamber 35 whose fluid pressure is regulated by the on-off valve 2. Instead of the above-described structure, the oil supply apparatus for the vehicle may be structured without using the on-off valve 2 or the second pressure working chamber 35. In this case, the predetermined fluid pressure serving as the criterion is fixed and provided by the spring 33. However, a simple structure is achieved.

Figure 4:
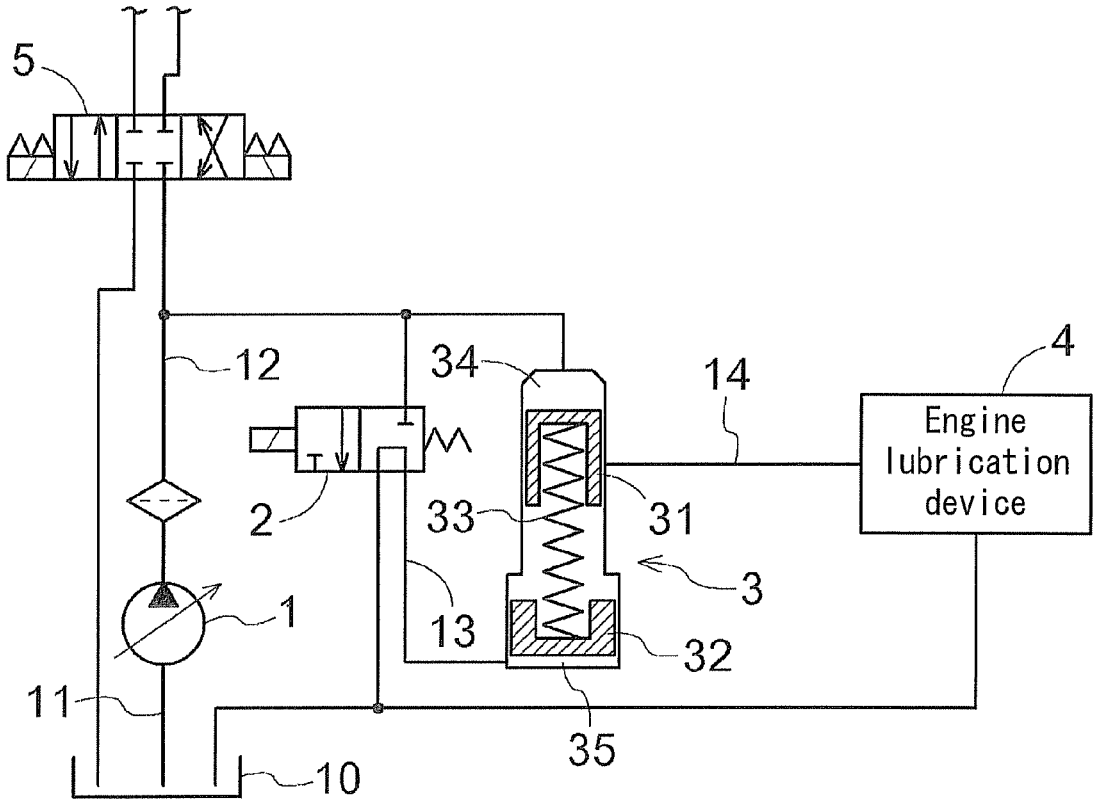
FIG. 4 is a configuration diagram showing the oil supplying apparatus for the vehicle according to another embodiment of the present invention.

(2) In the first embodiment, the priority flow valve 3 is positioned upstream of both the valve timing control system 6 and the engine lubrication device 4, and downstream of the oil pump 1 from a viewpoint of the oil flow. That is, the priority flow valve 3 is connected to the valve timing control system 6 using a serial connection in terms of a hydraulic circuit. This prevents the oil from escaping from the valve timing control system 6 even when the engine is stopped when the priority flow valve 3 is closed. Meanwhile, as shown in FIG. 4, the valve timing control system 6 and the engine lubrication device 4 may be parallelly connected to the oil pump 1 in terms of the hydraulic circuit. In this case, however, a countermeasure needs to be taken to prevent the oil from escaping from the valve timing control system 6 by use of a stop valve or the like when necessary.

Figure 5:
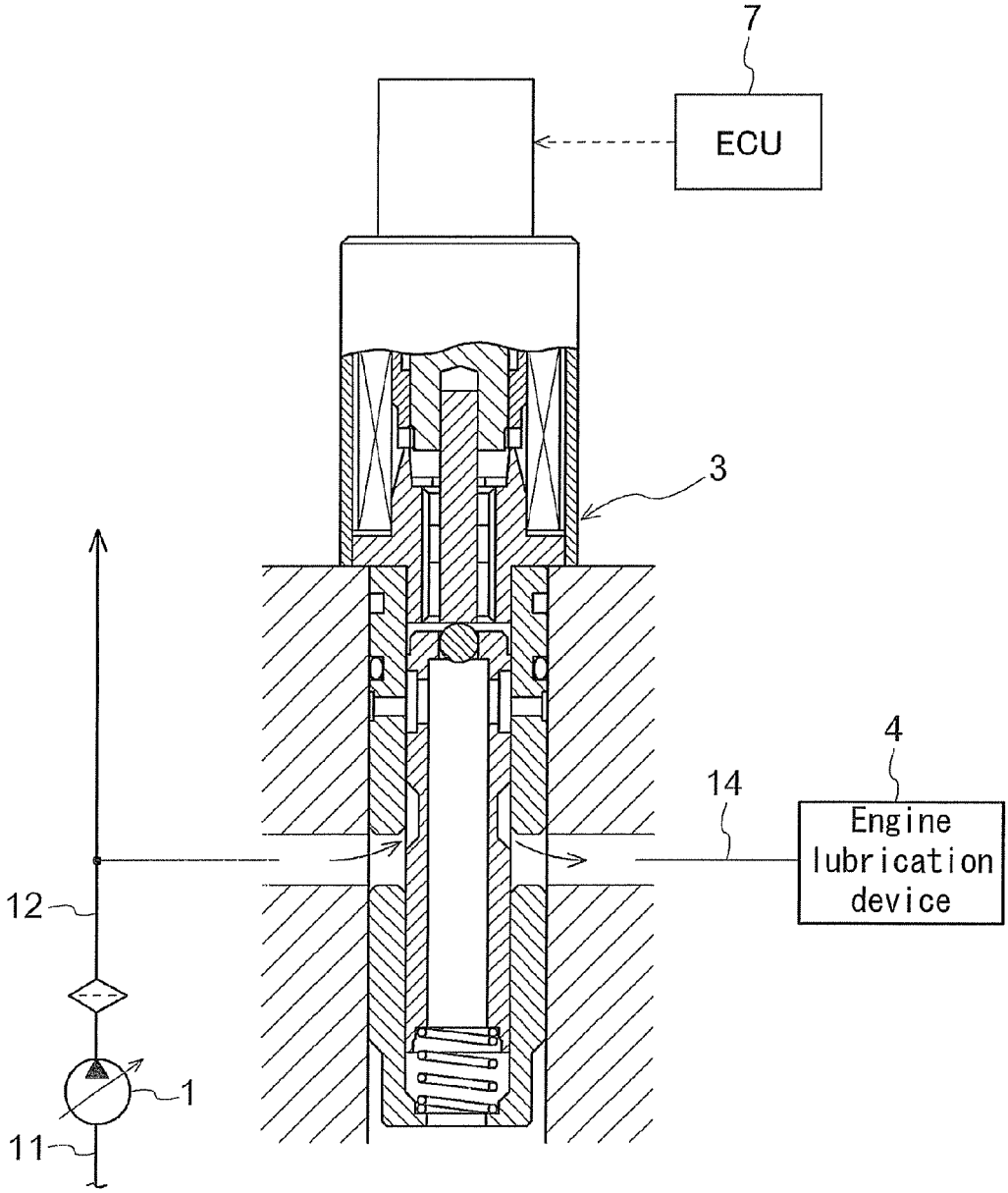
FIG. 5 is a configuration diagram of the oil supplying apparatus for the vehicle, where an electric variable throttle valve is provided.

(3) In the first embodiment, the priority flow valve 3 includes the structure of the variable pressure valve for selecting a destination of the oil flow according to a fluid pressure of the hydraulic circuit that works on the valve body 31. Instead of the above-described structure, an electric variable throttle valve 3 may be used which includes a spool that is displaced when a solenoid is excited by a control signal from the ECU 7 as shown in FIG. 5. In FIG. 5, the electric variable throttle valve 3 is provided on the oil supply passage 14 which branches from the oil discharging passage 12 giving a fluid communication between the oil pump 1 and the valve timing control system 6 (hydraulic actuator) and leads into the engine lubrication device 4. Further, a sensor for detecting the fluid pressure working on the valve timing control system 6 is connected to the ECU 7, so that the electric variable throttle valve 3 is controlled so as to restrict the oil flow from the oil pump 1 to the engine lubrication device 4 when the fluid pressure working on the valve timing control system 6 is low.

(4) In the first embodiment, the valve timing control system 6 is used as the hydraulic actuator where the priority flow valve 3 gives priority, as needed, to the oil supply from the oil pump 1 to the hydraulic actuator (that is, the primary flow). However, the present invention is not limited to this aspect, and may also be applied to various types of hydraulic actuators where appropriate operation responsiveness is ensured by obtaining a necessary and sufficient fluid pressure even when the discharge amount of the oil pump 1 is insufficient.

(5) In the first embodiment, the on-off valve 2 is controlled so that the fluid pressure to open the priority flow valve 3 is selectively set from between the two fluid pressure values, depending on whether the oil is supplied to the second pressure working chamber 35 or discharged from the second pressure working chamber 35. However, a structure may also be applied where an oil control valve (OCV) is used instead of the on-off valve 2 and a duty control is performed so that the valve opening pressure of the priority flow valve 3 is controlled to be at an arbitrary pressure. That is, the on-off valve 2 of the present invention may be controlled so as to provide other valve opening pressures than the valve opening pressure in the two stages.

A capacity of a space in the priority flow valve 3 between the valve body 31 and the retainer 32, where the spring 33 is accommodated, increases and decreases. Therefore, a breathing hole needs to be provided for taking the air into the space and discharging the air out of the space.

With the above-described structure, when the fluid pressure of the oil supplied from the oil pump 1 is equal to or less than the predetermined fluid pressure, the oil supply from the oil pump 1 to the engine lubrication device 4, that is the secondary flow, is restricted and the oil supply to the valve timing control system 6, that is the primary flow, is given priority, thereby the fluid pressure working on the valve timing control system 6 is easily ensured. Consequently, the fluid pressure working on the valve timing control system 6 is preferably ensured even when a rotation speed of the oil pump 1 is low, and thus the valve timing control system 6 is properly operated without using an electric oil pump for assisting the engine driven mechanical oil pump 1.

According to the first embodiment, the priority flow valve 3 is in a form of the regulation valve 3 regulating the amount of the secondary flow, wherein the regulation valve 3 regulates the amount of the secondary flow while the fluid pressure working on the valve timing control system 6 is lower than the fluid pressure required for operating the valve timing control system 6.

Consequently, the amount of the secondary flow is restricted by the regulation valve 3 when the fluid pressure working on the valve timing control system 6 is lower than the fluid pressure required for operating the valve timing control system 6. By use of the regulation valve 3, a desired fluid pressure working on the valve timing control system 6 is reliably ensured.

According to the first embodiment, the regulation valve 3 provides at least the first regulated state of the amount of oil flow and the second regulated state of the amount of oil flow, and the amount of oil flow regulated in the second regulated state of the amount of oil flow is greater than the amount of oil flow regulated in the first regulated state of the amount of oil flow.

According to the first embodiment, the regulation valve 3 is set in the second regulated state of the amount of oil flow when the valve timing control system 6 is requested to operate at a high speed and the regulation valve 3 is set in the first regulated state of the amount of oil flow when otherwise.

As a simplified form of the regulation valve 3, a pressure sensing switch valve is suggested, which restricts the supply of the secondary flow when the fluid pressure is less than the predetermined pressure and releases the restriction when the fluid pressure is equal to or greater than the predetermined value. For a more advanced pressure control, it is preferable that the regulation valve 3 is structured so as to provide at least a first regulated state of the amount of oil flow and a second regulated state of the amount of oil flow, where an amount of oil flow regulated in the second regulated state of the amount of oil flow is greater than the amount of oil flow regulated in the first regulated state of the amount of oil flow. Specifically, in case that the valve timing control system 6 is required to operate at two alternative different response speeds, it is preferable that the regulation valve 3 is structured to be set in the second regulated state of the amount of oil flow when it is necessary to operate the valve timing control system 6 at a high speed and in the first regulated state of the amount of oil flow when it is unnecessary to operate the valve timing control system 6 at the high speed. In this structure, by setting the regulation valve 3 in the second regulated state of the amount of oil flow when the valve timing control system 6 is required to have the improved responsiveness, the priority flow is supplied, as a result, the higher fluid pressure works on the valve timing control system 6. When a normal responsiveness of the valve timing control system 6 is acceptable, the regulation valve 3 may be set in the first regulated state of the amount of oil flow.

According to the first embodiment, the regulation valve 3 is set in the first regulated state of the amount of oil flow while the engine speed exceeds the predetermined speed and the regulation valve 3 is set in the second regulated state of the amount of oil flow while the engine speed is equal to or less than the predetermined speed.

Since the mechanical oil pump 1 is driven by the engine, the fluid pressure working on the valve timing control system 6 depends on the engine speed, consequently, the engine speed may be used in determining the regulated state of the amount of oil flow to be applied to the regulation valve 3. For example, the regulation valve 3 is structured to be set in the first regulated state of the amount of oil flow when the engine speed exceeds the predetermined speed and in the second regulated state of the amount of oil flow when the engine speed is equal to or smaller than the predetermined speed. As a result, the fluid pressure working on the valve timing control system 6 becomes equal to or higher than the desired fluid pressure, facilitating a smooth operation of the valve timing control system 6.

According to the first embodiment, the priority flow valve 3 is in the form of the pressure control valve 3 supplying the secondary flow when an inflow fluid pressure of the priority flow valve 3 exceeds the predetermined pressure.

According to the first embodiment, the predetermined pressure is equal to or greater than the fluid pressure required for operating the valve timing control system 6.

By using the pressure control valve 3 having the above-described structure, the supply of the secondary flow is restricted when the fluid pressure working on the valve timing control system 6 is equal to or less than the predetermined pressure, and thus the fluid pressure working on the valve timing control system 6 is rapidly increased up to the predetermined fluid pressure without applying a complicated electronic control. By setting the predetermined fluid pressure at or greater than the oil pressure required for operating the valve timing control system 6, the valve timing control system 6 is appropriately operated even when the engine speed is low.

According to the first embodiment, the oil supplying apparatus for the vehicle further includes a bypass oil passage 16 provided for bypassing the priority flow valve 3 and connecting the engine driven mechanical oil pump 1 to the engine lubrication device 4, and a throttle 16*a* provided on the bypass oil passage 16.

When the engine is running, the oil supply to the engine lubrication device 4 is occasionally required even in the small quantity. In this case, it is preferable that the bypass oil passage 16 is provided for bypassing the priority flow valve 3 and for connecting the oil pump 1 to the engine lubrication device 4, and that the throttle 16*a* is provided on the bypass oil passage 16. That is, even when the supply of the secondary flow is stopped by the priority flow valve 3 when the oil pressure working on the valve timing control system 6 is low, the throttle 16*a* enables a defined amount of oil to be supplied to the engine lubrication system 4 via the bypass oil passage 16. Consequently, the sufficient oil pressure works on the valve timing control system 6 and, at the same time, a minimum required amount of the oil is supplied to the engine lubrication system 4 while the engine speed is low.

According to the first embodiment, the priority flow valve 3 is provided between the engine driven mechanical oil pump 1 and the valve timing control system 6, and the priority flow valve 3 comes to be in the closed state for preventing the oil remaining between the valve timing control system 6 and the priority flow valve 3 from escaping while the engine driven mechanical oil pump 1 is stopped.

Consequently, the oil filling the oil supply passage 15 between the priority flow valve 3 and the valve timing control system 6 is not discharged to a drain and stays there after the engine is stopped, and then the oil pump 1 stops its operation. As a result, it is advantageous in that the oil pressure required for operating the valve timing control system 6 works thereon right after the engine starts to run and drive the oil pump 1.

According to the first embodiment, the regulation valve 3 is set in the first regulated state of the amount of oil flow when the engine speed exceeds the predetermined speed and a temperature of the oil is in a predetermined range, and the regulation valve 3 is set in the second regulated state of the amount of oil flow when otherwise.

According to the first embodiment, the regulation valve 3 is set in the first regulated state of the amount of oil flow when the engine speed exceeds the predetermined speed, the temperature of the oil is in the predetermined range, and a throttle opening exceeds a predetermined value, and the regulation valve 3 is set in the second regulated state of the amount of oil flow when otherwise.

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. An oil supplying apparatus for a vehicle, comprising:

an engine driven mechanical oil pump;

a hydraulic actuator operated by pressure of oil supplied from the engine driven mechanical oil pump to the hydraulic actuator;

an engine lubrication device lubricating each member of the engine with the oil supplied from the engine driven mechanical oil pump;

a priority flow valve selectively establishing priority flow and secondary flow conditions when a low oil pressure is working on the hydraulic actuator and when a high oil pressure is working on the hydraulic actuator, respectively, the priority flow condition allowing an oil supply from the engine driven mechanical oil pump to the hydraulic actuator with priority over an oil supply from the engine driven mechanical oil pump to the engine lubrication device, the secondary flow condition allowing the oil supply from the engine driven mechanical oil pump to the engine lubrication device; and wherein the priority flow valve is positioned between the engine driven mechanical oil pump and the hydraulic actuator so that the oil supplied from the engine driven mechanical oil pump flows through the priority flow valve before entering the hydraulic actuator, and the priority flow valve is configured to prevent residual oil remaining between the hydraulic actuator and the priority flow valve from escaping after the engine driven mechanical oil pump is stopped.

2. The oil supplying apparatus for the vehicle as set forth in claim 1, wherein the priority flow valve is in a form of a regulation valve regulating an amount of the secondary flow, wherein the regulation valve regulates the amount of the secondary flow while the fluid pressure working on the hydraulic actuator is lower than a fluid pressure required for operating the hydraulic actuator.

3. The oil supplying apparatus for the vehicle as set forth in claim 2, wherein the regulation valve provides at least a first regulated state of the amount of oil flow and a second regulated state of the amount of oil flow, the amount of oil flow regulated in the second regulated state of the amount of oil flow being greater than the amount of oil flow regulated in the first regulated state of the amount of oil flow.

4. The oil supplying apparatus for the vehicle as set forth in claim 3, wherein the regulation valve is set in the second regulated state of the amount of oil flow when the hydraulic actuator is requested to operate at a high speed and the regulation valve is set in the first regulated state of the amount of oil flow when otherwise.

5. The oil supplying apparatus for the vehicle as set forth in claim 3, wherein the regulation valve is set in the first regulated state of the amount of oil flow while an engine speed exceeds a predetermined speed and the regulation valve is set in the second regulated state of the amount of oil flow while the engine speed is equal to or less than the predetermined speed.

6. The oil supplying apparatus for the vehicle as set forth in claim 3, wherein the regulation valve is set in the first regulated state of the amount of oil flow when an engine speed exceeds a predetermined speed and a temperature of the oil is in a predetermined range, and the regulation valve is set in the second regulated state of the amount of oil flow when otherwise.

7. The oil supplying apparatus for the vehicle as set forth in claim 3, wherein the regulation valve is set in the first regulated state of the amount of oil flow when an engine speed exceeds a predetermined speed, a temperature of the oil is in a predetermined range, and a throttle opening exceeds a predetermined value, and the regulation valve is set in the second regulated state of the amount of oil flow when otherwise.

8. The oil supplying apparatus for the vehicle as set forth in claim 1, wherein the priority flow valve is in a form of a pressure control valve supplying the secondary flow when an inflow fluid pressure of the priority flow valve exceeds a predetermined pressure.

9. The oil supplying apparatus for the vehicle as set forth in claim 8, wherein the predetermined pressure is equal to or greater than a fluid pressure required for operating the hydraulic actuator.

10. The oil supplying apparatus for the vehicle as set forth in claim 1 further comprising:

a bypass oil passage provided for bypassing the priority flow valve and connecting the engine driven mechanical oil pump to the engine lubrication device;

and a throttle provided on the bypass oil passage.

11. The oil supplying apparatus for the vehicle as set forth in claim 1, wherein the priority flow valve allows the oil supply from the engine driven mechanical pump to both of the hydraulic actuator and the engine lubrication device when the oil pressure supplied to the hydraulic actuator exceeds the predetermined value.

12. An oil supplying apparatus for a vehicle, comprising:

an engine driven mechanical oil pump;

a hydraulic actuator activated while being in receipt of fluid under pressure supplied from the engine driven mechanical oil pump;

an engine lubrication device causing the fluid supplied from the engine driven mechanical oil pump to lubricate engine parts;

a priority flow valve giving a priority to the fluid pressure supply to the hydraulic actuator from the engine driven mechanical oil pump relative to the fluid supply to the engine lubrication device from the engine driven mechanical oil pump when the fluid pressure supplied to the hydraulic actuator drops below a predetermined value; and wherein the priority flow valve is positioned between the engine driven mechanical oil pump and the hydraulic actuator so that the fluid supplied from the engine driven mechanical oil pump flows through the priority flow valve before entering the hydraulic actuator, and the priority flow valve is configured to prevent residual fluid remaining between the hydraulic actuator and the priority flow valve from escaping after the engine driven mechanical oil pump is stopped.

13. The oil supplying apparatus as set forth in claim 12, wherein the priority flow valve is in the form of a regulation valve that is designed to decrease an amount of the fluid supplied to the engine lubrication device when the fluid pressure supplied to the hydraulic actuator drops below a predetermined value.

14. The oil supplying apparatus as set forth in claim 12, wherein the regulation valve takes selectively first and second conditions for allowing larger and smaller amount of the fluid, respectively, to pass.

15. The oil supplying apparatus as set forth in claim 14, wherein the regulation valve takes the first condition whenever the hydraulic actuator is requested to run at higher speeds, while the regulation valve takes the second condition when otherwise.

16. An oil supplying apparatus for a vehicle possessing an engine, the oil supplying apparatus comprising:

a mechanical oil pump powered by the engine and configured to generate pressurized oil, wherein a pressure of the pressurized oil generated by the mechanical oil pump varies according to engine speed;

a hydraulic actuator;

an engine lubrication device configured to lubricate the engine;

a priority flow valve configured to receive the pressurized oil from the mechanical oil pump and selectively output the pressurized oil to the hydraulic actuator and the engine lubrication device based on the pressure of the pressurized oil generated by the mechanical oil pump;

a first hydraulic conduit extending between the priority flow valve and the hydraulic actuator, and configured to convey the pressurized oil between the priority flow valve and the hydraulic actuator;

a second hydraulic conduit extending between the priority flow valve and the engine lubrication device, and configured to convey the pressurized oil between the priority flow valve and the engine lubrication device;

a third hydraulic conduit, separate from the first and second hydraulic conduits, extending between the mechanical oil pump and the priority flow valve, and configured to convey pressurized oil between the mechanical oil pump and the priority flow valve;

wherein the priority flow valve permits flow of the pressurized oil along the first hydraulic conduit and the second hydraulic conduit when the mechanical oil pump generates pressurized oil having a first pressure;

wherein the priority flow valve permits flow of the pressurized oil along the first hydraulic conduit and obstructs flow of the pressurized oil along the second hydraulic conduit when the mechanical oil pump generates pressurized oil having a second pressure, the second pressure being less than the first pressure; and wherein the priority flow valve obstructs the first hydraulic conduit after the engine ceases powering the mechanical oil pump so that at least a portion of residual oil remaining in the first hydraulic conduit after the mechanical oil pump stops operating is prevented from flowing back into the priority flow valve.

* * * * *